United States Patent [19]

Dixon et al.

[11] 4,020,223

[45] Apr. 26, 1977

[54] FLUORINATION OF POLYOLEFIN AND POLYACRYLONITRILE FIBERS

[75] Inventors: Dale D. Dixon, Kutztown; Larry J. Hayes, Macungie, both of Pa.

[73] Assignee: Air Products and Chemicals, Inc., Allentown, Pa.

[22] Filed: Oct. 30, 1975

[21] Appl. No.: 627,029

Related U.S. Application Data

[63] Continuation-in-part of Ser. No. 434,284, Jan. 17, 1974, abandoned.

[52] U.S. Cl. ..... 428/224; 8/115.5; 264/83; 427/248 R; 427/400; 428/225; 428/364; 428/394; 428/400; 428/421; 526/43

[51] Int. Cl.[2] ..... B32B 27/00; D02G 3/00; D04H 1/58

[58] Field of Search ..... 428/375, 394, 364, 365, 428/400, 421, 422, 224, 225; 8/115.5, DIG. 9; 526/43, DIG. 23; 260/96 HA; 427/400, 248 R; 264/83

[56] References Cited

UNITED STATES PATENTS

| | | | |
|---|---|---|---|
| 2,811,468 | 10/1957 | Joffre | 260/94.9 X |
| 2,829,070 | 4/1958 | Osborn | 428/480 |
| 3,255,099 | 6/1966 | Wolinski | 204/169 |
| 3,364,056 | 1/1968 | Seibel | 427/223 |
| 3,758,450 | 9/1973 | Margrave et al. | 526/43 |

*Primary Examiner*—Lorraine T. Kendell
*Attorney, Agent, or Firm*—Richard A. Dannells; Barry Moyerman

[57] ABSTRACT

The present invention relates to surface modification of synthetic resin fiber form materials, notably polyolefin and polyacrylonitrile fiber form materials whose surface has been modified by treatment with elemental fluorine, and to the fluorination process.

12 Claims, No Drawings

FLUORINATION OF POLYOLEFIN AND POLYACRYLONITRILE FIBERS

CROSS-REFERENCE TO RELATED APPLICATIONS

This application is a continuation-in-part of application Ser. No. 434,284, filed Jan. 17, 1974, and now abandoned.

BACKGROUND OF THE INVENTION

The advent of synthetic resin films and fibers with chemical make up substantially different from the long known natural products like wool and cellulose has required the art to intensively investigate various methods of surface treatment of films, dyeing fabric and the like. The workers in the art had a natural tendency to equate film treatment with fiber treatment, to equate treatment of polyolefins, polyamides, polyesters, polyacrylonitriles, etc., to equate chlorine with fluorine. In addition, the art has focused on a relatively limited number of properties, notably heat sealing adhesion, dye or printing ink receptivity.

The applications, Ser. No. 342,001, filed Mar. 16, 1973 and Ser. No. 342,157, filed Mar. 16, 1973, now abandoned, had principally directed attention to the improvement in print and in dye receptivity, heat sealing, oil and grease barrier properties. However, other surface characteristics are more important when the material under consideration is in an already dyed fabric form. Good soil and stain release and water absorbitivity are highly desirable characteristics.

THE INVENTION

Briefly stated, the present invention involves subjecting fiber form synthetic resins selected from the group consisting of polyolefins and polyacrylonitriles to a fluorination treatment. Such treatment is effected in an atmosphere of low oxygen content, for relatively brief periods of exposure. A mold fluorination treatment is intended. In no event is the fiber form resin fluorinated to a combined fluorine content in excess of 5% and preferably far less than 1% by weight of the fiber.

As a result of the fluorination treatment the fiber form material will be fluorinated in the surface layers only. The fluorination level can be expressed as being from $4 \times 10^{-7}$ to $4 \times 10^{-1}$ mg F/cm$^2$.

In accordance, then, with the present invention, polyolefins or polyacrylonitrile materials are fluorinated in the presence of elemental oxygen, that is to say, by a mixture of carrier gas, elemental fluorine, and elemental oxygen. Low levels of elemental oxygen are preferred. High levels are detrimental to the treatment. However, commercially available fluorine, as well as commercially available inert carrier gases, like nitrogen, may contain minor quantities of oxygen and the essentially unavoidable oxygen present both in the gases, and in the equipment employed for fluorinations will often suffice to provide the requred oxygen content.

As a practical matter, fluorination may be successfully practiced with elemental oxygen being present up to about 5% by volume in the fluorination locus. Nevertheless, most optimally, it is preferred that the level of oxygen present be much lower, i.e., less than 2% being more desirable, less than 1% being preferred, and 0.2–1.0% the preferred range.

Thus, in carrying out the objectives of the present invention a fluorinating mixture comprising generally from about 0.1% to about 20% elemental fluorine from about 0.1–5.0% elemental oxygen and correspndingly from about 99.8% to about 75% of carrier gas may be used to fluorinate the fiber form polyolefin or polyacrylonitrile resins. For most applications, the quantity of fluorine in the gaseous mixture feed to the fluorination will range from 0.1% to about 10%. A more preferable and economical range is from about 0.5% to about 10% fluorine. The fluorine content at the fluorination locus is always lower, sometimes as low as 0.1%.

During fluorination of polyolefins and polyacrylonitriles in accordance with the present invention, a fluorinated carboxylated layer is formed on the polymer surface. The formation of such a layer has been confirmed by means of an electron microscope, by infrared spectoscopy and by direct titration tests made after the fluorinated product has been subjected to a standard wash cycle.

The combined fluorine groups and the carboxylate groups are concentrated at the fiber surface, i.e., within about 300A° of the fiber surface. What is not known for certain is the reaction mechanisms and the chemistry involved in the formation of carboxylate groups as incident to fluorination. The explanation of the fluorination reaction offered below is conjecture being posed without intent to bind the demonstrable advantageous results achieved by practice of this invention to as yet unproven theory.

Examination of the literature concerning direct fluorination shows inconsistencies in the physical properties of fluorinated polyolefin films. For example, according to Schonhorn (J. Applied Polymer Science 12 1231 1968) "polar groups are not introduced" by direct fluorination and the polyethylene surface has wettability properties similar to conventional Teflon. On the other hand, U.S. Pat. Nos. 3,657,613 and 2,811,468 allege properties for fluorinated polyethylene indicative of a functionalized surface (increased printability, permeability to polar liquids and impermeability to non-polar liquids). Infra-red studies conducted on fluorinated high density polyethylene to determine the type and source of functional groups shows strong evidence for the generation of acid fluoride groups on the surface of polyethylene films during fluorination. The acid fluoride group can be hydrolyzed to an acid which in turn forms a sodium salt. Treatment of the sodium salt with 10% HCl regenerates the acid. In summary, reactions carried out on the surface of the PE film appear to be the following:

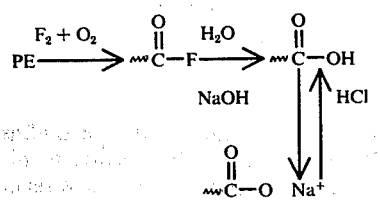

The generation of acid fluoride by fluorination appears to have a good analogy in the work of W. T. Miller (JACS 78 4992 (1956)) in which fluorine in the presence of oxygen brought about oxidation of pentachloroethane in the following manner:

$$CCl_3-CCl_2H+F_2 \longrightarrow CCl_3-CCl_2^{\circ}+HF+F^{\circ}$$

$$CCl_3-CCl_2^{\circ}+O_2 \longrightarrow CCl_3-CCl_2O_2^{\circ}$$

$$CCl_3-CCl_2O_2^{\circ} \longrightarrow CCl_3-C-Cl\,.\,COCl_2+ClO^{\circ}+Cl^{\circ}$$

The presence of elemental oxygen in the reaction medium is believed to account for acid fluoride groups and their carboxylic acid group hydrolysis product by the following mechanisms:

$$F_2 \longrightarrow 2F.$$

$$\sim CHF_2 + F. \longrightarrow \sim \dot{C}F_2 + HF$$

$$\sim \dot{C}F_2 + O_2 \longrightarrow \sim \overset{F}{\underset{F}{C}}-O-O$$

$$\sim \overset{F}{\underset{F}{C}}-O-O. \longrightarrow \sim \overset{O}{\overset{\|}{C}}-F + OF.$$

$$\sim CHF_2 + OF. \longrightarrow \sim \overset{O.}{\underset{F}{C}}-F + HF$$

$$\sim \overset{O.}{\underset{F}{C}}-F \longrightarrow \sim \overset{O}{\overset{\|}{C}}-F + F.$$

and/or $$F_2 \longrightarrow 2F.$$

$$\sim CF_2-CHF\sim + F. \longrightarrow \sim CF_2-\dot{C}F\sim + HF$$

$$\sim CF_2-\dot{C}F\sim + O_2 \longrightarrow \sim CF_2-\underset{O-O.}{CF}\sim$$

$$\sim CF_2-\underset{O-O.}{CF}\sim \longrightarrow 2\sim \overset{O}{\overset{\|}{C}}-F + F.$$

Fluorination of polyacrylonitrile, i.e.

$$\left(-CH_2-\underset{CN}{CH}\right)_n-$$

seems to follow the pattern of the polyolefins, except that the CN group becomes fluorinated readily.

In either event fluorination is a surface reaction with relatively little subsurface penetration by the fluorine. Both carboxylate groups and combined fluorine are concentrated within 300A° of the fiber surface. A self correcting situation seems to exist. The barrier against subsurface penetration of the fluorine directs the fluorine towards fresh fiber surface areas as yet unfluorinated. In consequence, fiber or a woven or knit fabric (before or after dyeing) may be fluorinated surprisingly uniformly. Indeed, the thread of a fabric may be wound on a spool and fluorinated. Fluorination will, of course, occur initially on the immediately exposed surfaces but subsequently the less exposed fiber surfaces such as exist in the interstices of the weave or knit and deep in the spool will fluorinate preferentially to fluorination subsurface of the more exposed surfaces.

The self correcting nature of the fluorination reaction is what makes practice of this invention applicable to all fiber forms of the polyolefins and polyacrylonitriles, including for example monofilaments, spun chopped fibers, weaves, non-woven fabrics, knits. However, differences exist between polyacrylonitriles and polyolefins, with the former being more sensitive, requring milder fluorination treatment conditions (because yellowing occurs). In addition, the fiber diameter must be considered, with finer denier fibers requiring milder treatment than heavier fibers and yarns.

The fluorination scission process probably takes place at random locations along the polymer chain. The extent of carboxyl formation is dependent on the reaction conditions and the resin system. Indications are that the number of acid groups increase as reaction time is increased at a given fluorine concentration or alternatively with increasing fluorine concentration.

When oxygen is carefully excluded, and relatively high fluorination levels employed, reduced carboxyl content results. However, oxygen also acts to repress fluorination so the principal effect of high, e.g. 5–7% oxygen content is slower reaction rate and decreased fluorination of the fiber, but not, it is believed, any increase in the carboxyl content with increasing oxygen beyond about 1:5 O/F ratio. No realistic minimum ratio is known. Both the oxygen and fluorine levels may be adjusted to achieve best results with individual fibers and fabrics.

In any event, chemical theory aside, the fluorinated polyolefin or polyacrylonitrile resin fiber has exceedingly desirable properties, notably soil release and good water adsorption or moisture transport. The moisture transport property, measured by a wicking test, is attributable to presence of the carboxylate groups. An improvement in moisture transport is achieved both in poyolefin and polyacrylonitriles.

Untreated fabrics formed from polyolefin resin fibers, notably polypropylene, are permanently stained by hydrocarbon and triglyceride oils. Such stains largely lift off under ordinary washing conditions from the fluorinated fiber fabrics. Even when the oil stain has literally been forced into the fabric, washing of the fluorinated fabric appears to remove much of the oil stain. Since polyacrylonitriles already exhibit good stain release properties, the improvement which occurs upon fluorination is nominal, as a practical matter and the stain release improvement is limited to polyolefins.

The carboxylate groups do not detract from the strain and soil release qualities and may even enhance this property. The carboxylate groups created by fluorination are believed to be most advantageous, being directly accountable for the higher water adsorbency of the fluorinated polyacrylonitrile and polyolefin fiber.

Basically, the wicking test is a test to determine the moisture transport of the fiber and fabrics formed therewith. The synthetics, including the polyolefins and polyacrylonitriles, have been condemned for their lack of water absorptivity. They have been called clammy, not, sticky, because all but the smallest amount of free moisture of the surface of fabrics made from the synthetic resins remain there as free moisture. The fabric is unable to absorb or wick away the moisture. Moisture absorbency is one material property where cotton and rayon are superior to the polyolefins and polyacrylonitrile fibers. The sharply enhanced wicking of the surface fluorinated and carboxylated polyolefin and polyacrylonitrile fiber constitutes a measure of an improvement in water adsorptivity.

Although carboxylate groups on the fiber surface are an ultimate reaction product, they may not be created until the fiber is washed. Some possibility exists that the carboxylate groups form as the acyl fluoride, and only later hydrolyze to the carboxylate. Certainly some loss of fluoride occurs upon an initial washing, and thereafter little or no loss of fluoride occurs upon repeat washing. Laundering with its alkaline conditions will, in theory, at least, convert any free carboxylic acid surface groups to the sodium carboxylate form. In this connection, treated fabrics washed and then specially acid rinsed, exhibit the same wicking level as like fabrics water rinsed (pH - 7.0) or laundered under alkaline conditions.

Age and repeated laundering or dry cleaning do not seem to materially affect fluorine content and carboxylate groups content of the fibers. Fabrics fluorinated according to practice of this invention have been laundered repeatedly without losing their good wicking properties or in the instance of polyolefins their soil release properties and their good anti-deposition properties.

In any event, whatever the reaction mechanism, surface fluorination of polyolefin and polyacrylonitrile resins in the presence of oxygen do create surface carboxylate groups. In this respect, fluorination is quite different from chlorination, even chlorination effected in the presence of activation (e.g. by ultra violet light), since chlorination does not create surface carboxylate groups to any significant degree. Accordingly, a substitution of chlorination for the fluorination fails to produce surface treated fibers with good wicking properties.

Fluorination does not materially affect tensile strength, short of what is believed to be excessive fluorination levels. Incorporation of 1.7% by wt. of F (at 10% $F_2$ reaction) in polypropylene did not decrease tensile strength. In the case of polyacrylonitriles, a mild fluorination is preferred to avoid discoloration, i.e. yellowing of the fiber.

Accordingly, practice of this invention involves fluorination to the least reasonable extent, employing the most dilute fluorine (in a carrier gas), consistent with the level of reaction desired with never more than 20% fluorine content in the gas at the fiber surface. A low fluorine content in the gas helps cool the reaction and facilitates the preferential reactions desired for achieving uniform fluorination of fiber surfaces.

One realistic measurement for the fluorination reaction is, of course, the number of fluoride groups present on the fiber surface, with the meaningful value for fluorine content being the wt. (mg) of fluorine per $cm^2$ of fiber surface, preferably measured after washing the fluorinated fiber.

Measurement convenience will often dictate testing some weight of fiber or fabric then computing the carboxylate and fluoro groups present on the surface from fiber diameter, and density.

The fluoride content range for both polyolefin and polyacrylonitrile are the same; about $4 \times 10^{-7}$ to $4 \times 10^{-1}$ mg F/$cm^2$; with preferred ranges of about $6 \times 10^{-5}$ to $1 \times 10^{-2}$ mg F/$cm^2$. However, it should be appreciated that actual practice of the invention always involves a particular treatment level, e.g. $5 \times 10^{-5}$ for a specific fiber material. The preferred treatment level will be different for each class of substrates, and takes into account fiber size, fabric weave count, etc. Treatment conditions are of course selected for the minimum treatment level consistent with the circumstances at hand. For example, if polyacrylonitrile filaments are being treated, a fluorination treatment to achieve $1 \times 10^{-4}$ mg F/$cm^2$ will be preferred. On the other hand, treatment of a bulk fabric wound on a spool may well require fluorination treatment to $3 \times 10^{-3}$ mg F/$cm^2$ in order to be certain that all of the fabric had been fluorinated. Polypropylene may be more heavily fluorinated, e.g. $1.5 \times 10^{-4}$ mg F/$cm^2$ and $6.5 \times 10^{-3}$ mg F/$cm^2$, the latter involving a carboxyl content increase from 0 Meq/$cm^2$ (control) to $9.57 \times 10^{-6}$ meq/$cm^2$. (The fluoride content values provided above are after wash values.)

The carboxylate content in milliequivalents per $cm^2$ would seem to be a definitive measurement of the fluorination and carboxylation reaction product of the present invention, a direct indication being the neutralization equivalent. Unfortunately, accurate measurement of carboxyl content has proven difficult, and the neutralization values obtained may be unreliable. However, the increase in free carboxyl content relative to a comparable unfluorinated control is clear and substantial. Both polyacrylonitrile and polyolefin fibers contain a significant carboxyl content of up to about $1 \times 10^{-4}$ meq/$cm^2$. Since excessive fluorination is undesirable, and carboxylation levels are not the only factor affecting wicking, practice of this invention will usually involve a much lower meq/$cm^2$.

For treatment of bulk fabric, practice of this invention may involve fluorination after the fabric has been dyed. Fluorination has no adverse effect on most dyed polyacrylonitriles and polyolefins, and in the instance of bulk fabrics the almost inevitable minor degree of nonuniformity in fluorine content and wicking characteristics in the fabric will be immaterial to fabric appearance, use and strength.

DESCRIPTION OF PREFERRED EMBODIMENTS

In accordance with preferred practice of present invention, fluorinated carboxylated polyolefins are obtained by short cycle, direct fluorination in an atmosphere with low oxygen content as described above. By short cycle is intended gas-solid reaction contact time of less than 15 minutes, preferably less than 5 minutes between fiber and fluorine. The resulting fluorinated carboxylated polyolefin materials prepared by an abbreviated cycle have increased water transport and soil release characteristics.

Practice of this invention is applicable generally to fibers from polyolefins and polyacrylonitriles, including homopolymers and resin mixtures and copolymers. Preferred by far for the fluorination carboxylation treatment are the polypropylene and polyacrylonitrile resin fiber form materials. The polypropylene materials fluorinate carboxylate readily. The polyacrylonitrile materials should be subjected to relatively mild fluorination conditions in order to avoid discoloration.

The fluorination carboxylation can be carried out on a continuous basis, for example, by passing a fiber form material, such as yarn, fabric, etc. through the fluorine carrier gas mixture in a suitably sealed chamber through which the fiber form material passes. Alternatively, the material can be unrolled and rerolled inside the treatment chamber.

Instead of a continuous treatment such as described above, the treatment may be a batch operation in which the fiber form material is exposed to the fluorine carrier gas mixture in a reactor: the material being permitted to remain in contact with the gas mixture for a brief time interval.

Within the limits of the material (e.g...melting point, etc.), the temperature and pressure at which the fiber form material is treated is not critical. However, the preferred temperature is room temperature, but higher temperatures, such as those ranging up to about 150° C or higher can be employed. Pressure inside the reaction vessel will ordinarily correspond to standard environmental pressures, although elevated pressures can be used without adverse effect.

As previously mentioned, direct fluorination in an atmosphere substantially free of oxygen requires only a brief reaction time for a fluorinated carboxylated surface layer to form on the material. It has been found, according to the present invention, that exposure time for most types of polyacrylonitrile and polyolefin resin fiber form materials generally requires less than five minutes. However, frequently less than one minute contact time is all that is needed in order to form fluorinated carboxylated surface layer and such is a preferred mode here. It is well to keep in mind, however, the exposure period will vary with the concentration of fluorine and oxygen in the gas mixture, in which case the time will be shortened when the concentration of fluorine is higher. Longer exposure times may be used, but in most instances are neither required nor considered desirable, especially from an economic viewpoint.

Again and again reference has been made to the desirability of limiting the oxygen content of the fluorinating gas to the 1:5 ratio of 0:F. Water and water vapor are somewhat detrimental also and desirably should be avoided. In a preferred mode of this invention, the fabric should not be wet, i.e., in equilibrium with ambient moisture and the fluorinating gas contain 0.2–1% oxygen and from 1–5% fluorine for polyolefins, 1–5% for polyacrylonitriles, the balance of the fluorinating gas may be inert e.g. nitrogen, and such is preferred. However, practice of this invention does contemplate fluorination in the presence of co-reactant gases. For example, fluorination and chlorination will both occur if chlorine is included in the carrier gas, even though chlorination by itself which requires light activation would not occur in the absence of light. Accordingly, presence of other reactants in the carrier gas is not inconsistent with fluorination, and, indeed, the co-reaction will normally take place only as incident to the fluorination.

The significant process aspects for practice of this invention may be recapitulated as follows:

1. — A reaction contact time between fiber form resin and reaction gases of less than about 15 minutes, less than 10 minutes being more desirable, and less than 5 minutes preferred.
2. — A reaction gas composition having, by volume:
   a. up to 20% elemental fluorine, less than 10% preferred, 0.5–5% being more desirable; specifically preferred is 1–5% for the treatment.
   b. limiting elemental oxygen content preferably to below 1:5 $O_2/F_2$ preferred 1–5% $F_2$ range, e.g. 0.2–1.0%.
   c. balance of reaction gas preferably dry and inert.

When following the conditions noted above for fluorination according to practice of the present invention, it has been found the material will not char; there is little loss of other desirable characteristics of the material such as strength; low levels of fluorine are taken up by the fiber rather uniformly. Of course, the reaction vessel used in the fluorination process must be able to withstand the presence of fluorine and of hydrogen fluoride product of the reactions.

In the discussion of fluorination, exemplary values and preferred ranges have been provided. The values given for exemplary purposes are the fluorine content at the first realistic opportunity to measure same. Normal handling of the fiber form resin such as laundering will remove some but not all of the fluorine initially combined with the fiber form resin material. Except when indicated as pre-washing, the fluoride content values are after a first washing of the material.

The fluorinated-carboxylated polyolefins and polyacrylonitriles prepared according to practice of this invention have a neutralization equivalent of about $1 \times 10^6$ or less, preferably less than $2 \times 10^5$. The neutralization equivalent (N.E.) is determined by dividing the weight (grams) of the acid times 1,000 by the milliliters of base times the normality of the base i.e., the "meq. of base".

$$N.E. = \frac{\text{wt. of Acid} \times 1{,}000}{meq.\ \text{of base}}$$

The neutralization equivalent is measured by an acid-base potentiometric titration performed in absolute methanol using a glass electrode as an indicator against a calomel reference electrode. The potential is measured on a pH meter (e.g. Beckman pH meter).

The carboxyl content of the fiber form resins may be determined in several ways. According to one procedure, the fluorinated material, e.g. a fabric, is first washed in dilute HC1, then thoroughly rinsed with distilled water, dried and weighed. Thereafter the material is immersed in a known amount of 0.0995 N methanolic sodium hydroxide, allowed to stand for 24 hours, then carefully rinsed with methanol to wash adhering base back into solution. The solution is then titrated with aqueous hydrochloric acid. The difference between the initial amount of NaOH and that measured represents the degree of acidity of the fabric.

An alternative procedure, interchangeable with the above, is the process of H. A. Pohl, Analytical Chemistry, Vol. 26, pg. 1614 (1954).

The degree of carboxylation of polyolefins and polyacrylonitriles will depend upon both reaction time $O_2$% and $F_2$% in the reaction medium. At a given reaction time, carboxylation increases as % fluorine incorporation increases. Selecting specific fluorination process conditions for a particular fabric may require a cut and try approach within the already described reaction time and oxygen and fluorine concentration ranges. In this connection, the degree of carboxylation of polyolefin and polyacrylonitrile are not believed to be related, since the chain cleavage rate may differ. Thus, polyacrylonitrile treated to have between $6 \times 10^{-5}$ and $1 \times 10^{-2}$ mg F/cm², a preferred range, will have a carboxyl content $2 \times 10^{-6}$ and $1 \times 10^{-4}$ milliequivalents/cm² against a control measurement of 0 meq/cm². A polyolefin control measured at 0 meq/cm² and a highly carboxylated specimen contained $1 \times 10^{-5}$ meq/cm².

The following Examples illustrate embodiments of this invention. It is to be understood, however, that these are for illustrative purposes only and do not purport to be wholly definitive as to condition and scope for preferred practice of the invention.

EXAMPLE I

To demonstrate the inter-relationship of oxygen and fluorine in the fluorination/carboxylation reactions, polyethylene film was employed (rather than fiber for test convenience reasons).

An infra-red monitoring technique was devised to measure carbon-fluorine formation in polyethylene film as a function of time at constant fluorine concentration (30% by volume) and varying oxygen concentration (0.01–70% by volume) with nitrogen being present as an inert ingredient.

An infra-red gas cell was equipped internally at each end with polyethylene film (1 ml) and externally with sodium chloride plates. A flow mixture of fluorine/oxygen/argon was allowed to pass through the cell and the rate of C-F formation on the polyethylene film was monitored at one or two minute intervals up to about 40 minutes of reaction time. The C-F absorbance at 9.0 microns recorded in the infra-red spectrum was then related to percent fluorine incorporation. The following Table 1 provides the weight percentage fluorine incorporated in the film.

TABLE 1

| Time (Min.) | % $O_2$ in Medium | % F Incorporated |
|---|---|---|
| 1 | 0.01 | 0.38 |
| 1 | 0.5 | 0.26 |
| 1 | 1.0 | 0.20 |
| 1 | 3.0 | 0.12 |
| 1 | 7.0 | 0.05 |
| 3 | 0.01 | 1.02 |
| 3 | 0.5 | 0.78 |
| 3 | 1.0 | 0.60 |
| 3 | 3.0 | 0.35 |
| 3 | 7.0 | 0.14 |
| 5 | 0.01 | 1.70 |
| 5 | 0.5 | 1.29 |
| 5 | 1.0 | 1.00 |
| 5 | 3.0 | 0.59 |
| 5 | 7.0 | 0.26 |
| 6 | 0.01 | 2.02 |
| 6 | 0.5 | 1.52 |
| 6 | 1.0 | 1.20 |
| 6 | 3.0 | 0.68 |
| 6 | 7.0 | 0.30 |
| 15 | 0.01 | 5.11 |
| 15 | 0.5 | 3.82 |
| 15 | 1.0 | 3.00 |
| 15 | 3.0 | 1.81 |
| 15 | 7.0 | 0.73 |

The Table 1 demonstrates that the rate of fluorination is dramatically affected by the presence of oxygen. Small concentrations of oxygen (0.01%) bring about dramatic decreases in the rate of polyethylene film fluorination. Higher concentrations of oxygen were also tested, resulting in somewhat lower rates of fluorination without significant difference between 7% oxygen and 70% oxygen.

The data of Table 1 suggests operation at low oxygen levels (0.01–7%) so that fast rates of fluorination can be achieved using relatively low concentrations of fluorine and, yet, maintain a balance between fluorine-induced properties, oxygen-induced properties.

The infra-red studies evidenced generation of acid fluoride groups on the surface of the polyethylene durig the fluorination. The studies also strongly indicated that the acid fluoride group was capable of hydrolysis to an acid which on treatment with base formed a sodium salt. Treatment of the sodium salt with 10% HCl regenerated the acid. (Such infra-red studies could not be conducted on fiber forms)

EXAMPLE II

Polypropylene tee shirt material was scoured, triple rinsed and tumble dried prior to fluorination. An 8 inch × 10 inch sample was then suspended in a 2 liter monel reactor. The reactor was evacuated and purged with nitrogen four 4 times. After the fifth evacuation the reactor was brought to atmospheric pressure by filling with the fluorine/nitrogen/oxygen mixtures. The fill time was 30 seconds and reaction contact time was 2 minutes. At the end of the 2 minute reaction time, the fabric was removed from the reaction and washed by standard AATCC wash procedure.

The test results are provided in the Tables below.

TABLE 2-A-1

| | FLUORINE INCORPORATION | | |
|---|---|---|---|
| % Fluorine | % $O_2$ | % Fluorine Before Wash | % Fluorine After Wash |
| 0.5 | 0.01 | 0.024 | 0.029 |
| 1.0 | 0.01 | 0.113 | 0.084 |
| 3.0 | 0.01 | 0.352 | 0.413 |
| 5.0 | 0.01 | 0.907 | 0.853 |
| 7.0 | 0.01 | 0.890 | 1.014 |
| 10.0 | 0.01 | 0.987 | 1.650 |

TABLE 2-A-2

| | FLUORINE INCORPORATION | | |
|---|---|---|---|
| $O_2$ % Oxygen | % $F_2$ | % Fluorine Before Wash | % Fluorine After Wash |
| 1.0 | 5% | 0.735 | 0.614 |
| 3.0 | 5% | 0.672 | 0.537 |
| 5.0 | 5% | 0.732 | 0.502 |

TABLE 2-B

| WICKING HEIGHT - 0.01% $O_2$ | |
|---|---|
| % Fluorine | Wicking Height in Mm |
| 0.5 | 53 |
| 1.0 | 56 |
| 3.0 | 0 |
| 5.0 | 0 |
| 7.0 | 0 |
| 10.0 | 0 |

TABLE 2-C

| | WICKING HEIGHT | |
|---|---|---|
| % Oxygen | % Fluorine | Wicking Ht. in Mm |
| 0.5 | 5.0 | 17 |
| 1.0 | 5.0 | 51 |
| 3.0 | 5.0 | 49 |
| 5.0 | 5.0 | 56 |

TABLE 2-D

| CARBOXYLATION DATA SUBSTANTIAL ABSENCE OF OXYGEN | | |
|---|---|---|
| | Lbs. COOH/cm² Incorporated - 0.01% $O_2$ | |
| % Fluorine | Lbs. COOH/cm² × $10^{15}$ | meq/cm² × $10^{-6}$ |
| 0.5 | 1.34 | 2.23 |

TABLE 2-D-continued

| CARBOXYLATION DATA SUBSTANTIAL ABSENCE OF OXYGEN Lbs. COOH/cm² Incorporated - 0.01% $O_2$ | | |
|---|---|---|
| % Fluorine | Lbs. COOH/cm² × $10^{15}$ | meq/cm² × $10^{-6}$ |
| 1.0 | 2.31 | 3.84 |
| 3.0 | 1.45 | 2.41 |
| 5.0 | 2.5 | 4.16 |
| 7.0 | 2.81 | 4.66 |
| 10.0 | 2.60 | 4.31 |

TABLE 2-E

| CARBOXYLATION DATA - PRESENCE OF OXYGEN Lbs. COOH/cm² Incorporated | | | |
|---|---|---|---|
| % Fluorine | % Oxygen | Lbs. COOH/ cm² × $10^{15}$ | meq/cm² × $10^{-6}$ |
| 5.0 | 0.5 | 5.13 | 8.52 |
| 5.0 | 1.0 | 4.81 | 7.99 |
| 5.0 | 3.0 | 8.79 | 14.6 |
| 5.0 | 5.0 | 5.76 | 9.57 |

TABLE 2-F

| WICKING HEIGHT vs. F/COOH RATIO | |
|---|---|
| F/COOH Ratio | Wicking Height in mm |
| 4 | 53 |
| 6 | 56 |
| 13 | 56 |
| 19 | 52 |
| 25 | 17 |
| 44 | 0 |
| 55 | 0 |
| 57 | 0 |
| 103 | 0 |

TABLE 2-G

| TENSILE STRENGTH vs % FLUORINE | |
|---|---|
| % Fluorine | Tensile Strength in lbs. |
| 0 (Control) | 25 |
| 1.0 | 22.80 |
| 3.0 | 24.68 |
| 5.0 | 26.06 |
| 7.0 | 27.38 |
| 10.0 | 34.40 |

TABLE 2-H

| TENSILE STRENGTH | | |
|---|---|---|
| % Oxygen | % Fluorine | Tensile Strength in lbs. |
| 0.5 | 1.0 | 25.40 |
| 1.0 | 1.0 | 22.86 |
| 3.0 | 1.0 | 23.00 |
| 5.0 | 1.0 | 23.50 |
| 7.0 | 1.0 | 26.98 |
| 10.0 | 1.0 | 22.22 |
| 20.0 | 1.0 | 25.64 |

The results are evaluated as follows:

A — Rate of F incorporation.

In the absence of added oxygen, fluorine is incorporated at a rate which depends on the fluorine concentration. When oxygen is present, the rate of fluorine incorporation is retarded at a rate which depends on the oxygen concentration. The greatest retardation rate is experienced between 0.01 and 1% oxygen, which also is the range of greatest retardation found for polyethylene.

B — Stability of Incorporated F.

In the absence of added oxygen, the amount of fluorine lost during washing is very small and within the limits of error in the analytical procedure. The addition of oxygen to the fluorinating medium increases the amount of fluorine lost during AATCC washing.

C — Carboxyl Group Formation.

The polypropylene tee shirt material was prewashed in dilute HCl and thoroughly rinsed with distilled water, weighed and then immersed in a known amount of standardized sodium hydroxide. The fabric was allowed to stand for 24 hours and then was removed and carefully rinsed with methanol to wash any adhering base back into solution. The solution was then titrated with aqueous hydrochloric acid. The difference between the amount of sodium hydroxide put in and that found after fabric soaking represented the degree of acidity of the fabric.

i. Fluorine Concentration Dependence

The last traces of oxygen adsorbed on polypropylene fiber cannot be easily removed and carboxylation occurs even in the absence of added oxygen. Increasing rate of carboxylation, in a system carefully evacuated and purged, is dependent on increasing fluorine concentration.

ii. Oxygen Concentration Dependence

Oxygen addition to a constant concentration of fluorine led to increasing carboxylation with increasing oxygen concentration.

iii. Fluorine/Carboxyl Ratio

The major influence on fluorine/carboxyl ratio is the presence of oxygen. Since oxygen has the double effect of retarding fluorine incorporation and increasing the rate of carboxylation, oxygen plays a very important role in determining the moisture transport properties of the treated polypropylene. Highest F/COOH ratios are obtained at 0% $O_2$ with the greatest rate of decrease between 0 and 1% $O_2$.

D. — Moisture Transport Properties of Fluorinated Polypropylene Tee Shirt Fabric i. Fluorination in the Absence of Added Oxygen In the absence of added oxygen only fluorination with low percentages of fluorine (0.1–2.0%) provides a fabric capable of transporting moisture. Polypropylene fabric treated with 3–10% fluorine, and the control as well, shows little or no moisture transport. The poor wicking qualities of heavily fluorinated polypropylene indicates that the F/COOH is significant.

ii. Fluorination in the Presence of Added Oxygen

Addition of oxygen in a high $F_2$ concentration fluorination treatment (5% $F_2$) imparted wicking properties to the fabric.

E — Tensile Strength Properties of Fluorinated Polypropylene Tee Shirt Fabric

Fluorination has little or no effect on the tensile strength of polypropylene fabric.

EXAMPLE III

A series of runs were conducted on polypropylene fabric sample according to the procedure of Example II. The conditions and test results are shown in Table III.

TABLE III

| TREATMENT OF POLYPROPYLENE FABRIC | | | | |
|---|---|---|---|---|
| Gaseous Mixture $F_2O_2/N_2$, Vol. % | Treatment Time, Min. | % F Incorp. | Wicking Height, mm. | Soil Release Rating |
| Control | — | — | 0 | 1.2 |
| 1/0.01/99 | 1 | 0.17 | 85 | 3.6 |
| 1/0.01/99 | 5 | 0.49 | 47 | 5.0 |

TABLE III-continued

| TREATMENT OF POLYPROPYLENE FABRIC | | | | |
|---|---|---|---|---|
| Gaseous Mixture $F_2O_2/N_2$, Vol. % | Treatment Time, Min. | % F Incorp. | Wicking Height, mm. | Soil Release Rating |
| 5/0.01/95 | 1 | 0.49 | 16 | 4.75 |
| 1/1/98 | 1 | 0.17 | 77 | 5.0 |
| 1/1/98 | 5 | 0.18 | 71 | 5.0 |
| 1/5/94 | 1 | 0.10 | 64 | 5.0 |
| 1/5/94 | 5 | 0.26 | 50 | 5.0 |
| 4/1/95 | 1 | 0.44 | 61 | 5.0 |
| 4/1/95 | 5 | 1.03 | 52 | 5.0 |

EXAMPLE IV

Polyacrylonitrile fabric (Acrilan -16) was fluorinated at varying fluorine concentrations and reaction times set out in the tables below. The oxygen content of the reaction media was not measured, but is estimated at below about 0.5%.

The material to be treated was placed in a monel reactor and then evacuated and purged with nitrogen to remove the oxygen present in the reactor and finally a mixture of fluorine/nitrogen was admitted as a continuous flow, at ambient temperature (about 75° F) and atmospheric pressure.

TABLE IV-A

| Sample | Gas Flows $F_2/N_2$ | Gas % $F_2/N_2$ | Reac. Tm. (Minutes) | % F Incorp. |
|---|---|---|---|---|
| Control | | | | 0.009 |
| 1838-31-1 | 40 cc/min–760 cc/min | 5/95 | 1 | 0.047 |
| 1838-31-3 | 40 cc/min–760 cc/min | 5/95 | 3 | 0.137 |
| 1848-7-1 | 147 cc/min–14.5 l/min | 1/99 | 1 | 0.035 |
| 1848-7-3 | 147 cc/min–14.5 l/min | 1/99 | 3 | 0.035 |
| 1848-7-6 | 147 cc/min–14.5 l/min | 1/99 | 6 | 0.035 |

No explanation is offered for the essentially constant after wash fluorine content of samples 1848. No before wash measurement was made. Other data indicates that incorporation of fluorine does increase with reaction time, but that a correspondingly greater loss occurs upon washing.

The fabric which had been fluorinated was cut into one inch strips and the ends immersed in an aqueous dye solution (wicking test). The rate of climb of the liquid was noted (Table IV-B). Wicking is considered a measure of comfort. The carboxylate content of fluorinated Acrilan is shown in the Table IV-C below:

TABLE IV-B

| Sample | Liquid Height After 20 Min. (MM) |
|---|---|
| Control | 52 |
| 1838-31-1 | 144 |
| 1838-31-3 | 139 |
| 1848-7-1 | 92 |
| 1848-7-3 | 93 |
| 1848-7-6 | 100 |

TABLE IV-C

| Sample | Reaction Conditions % $F_2$ | Time-Minutes | Milliequivalents $cm^2 \times 10^{-5}$ |
|---|---|---|---|
| Control | — | — | 3.13 |
| 1857-15 | 1 | 1 | 3.32 |
| 1870-4 | 1 | 1 | 4.85 |
| 1884-20-A | 1 | ½ | 2.75 |
| 1884-20-B | 1 | ½ | 3.81 |
| 1848-7-1 | 1 | 1 | 2.38 |
| 1848-7-3 | 1 | 3 | 4.61 |
| 1848-7-6 | 1 | 6 | 3.59 |

EXAMPLE V

A series of runs were conducted on polyacrylonitrile fabric according to the procedure of Example IV except oxygen was added to the reaction medium. The conditions and test results are shown below.

TABLE V

| Reaction Conditions % $F_2$ | % $O_2$ | Time-Min | 1 Inch Rise (sec.) | Moisture Transport Wicking Ht. (MM) | % $F_2$ Inc. | Stain Release Corn Oil |
|---|---|---|---|---|---|---|
| — | — | — | — | 52 | — | 5 |
| 1 | 1 | 1 | 41 | 92 | 0.027 | 5 |
| 1 | 1 | 5 | 47 | 86 | 0.022 | 5 |
| 1 | 5 | 1 | 30 | 98 | 0.022 | 5 |
| 1 | 5 | 5 | 40 | 96 | 0.022 | 5 |
| 4 | 1 | 1 | 38 | 89 | 0.062 | 5 |
| 4 | 1 | 5 | 150 | 65 | 0.44 | 5 |

EXAMPLE VI

This example serves as a control to compare the effect a treating gas mixture having a relatively high fluorine content has on film and fabric samples of polypropylene. It demonstrates that the fabric sample was detrimentally effected by such a treatment whereas the film sample was not visibly effected under the same conditions.

A fabric sample containing essentially 100% polypropylene obtained from Royal Manufacturing Company was scoured with a solution of tetrasodium pyrophosphate (TSPP) and a surfactant sold under the trademark Dupanol D to remove any oils that may have been present as a result of the knitting and finishing operations in the manufacture of the fabric. The fabric sample was then placed in a 5.3 liter reactor and the reactor was alternately evacuated and purged four times with nitrogen. A dilute fluorine gas mixture comprising 15% by volume fluorine, 80% by volume nitrogen and 5% by volume air (15% $F_2$84% $N_2$/1% $O_2$) was introduced into the reactor. The fabric sample was maintained in the presence of the dilute fluorine gas mixture at room temperature for a reaction time of 60 seconds and the reactor was purged several times with nitrogen. A completely charred fabric sample was removed from the reactor.

A sample of polypropylene film obtained from Hercules Corporation, gauge 100, was placed in the same reactor described above and the reactor was alternately evacuated and purged two times with nitrogen. A dilute fluorine gas mixture having the same compositon as that used in the fluorination of the fabric sample was introduced into the reactor and the film sample was maintained in the presence of this gas mixture at room temperature for a reaction time of 60 seconds. The reactor was then purged several times with nitrogen and the film sample removed from the reactor. No noticeable change had occurred in the film sample after the fluorination treatment.

Samples of the same polypropylene fabric and film used in the above experiments were simultaneously placed in a 200 liter reactor. The reactor was evacuated and purged twice with nitrogen and a fluorine gas mixture having the same composition as that used in the experiments described above was introduced into the reactor. The fabric and film samples were maintained in the presence of this gas mixture at room temperature for a reaction time of 60 seconds. The reactor was then purged several times with nitrogen and the samples were then removed from the reactor. The film sample remained visibly unchanged after the fluorination treatment while the individual fibers making up the fabric sample fused together to form a single melted strand which was rendered completely useless for its intended purpose.

The foregoing example supports the proposition that film and fabric of the same polymeric composition under the identical treatment conditions can not be regarded as equivalents.

We claim:

1. An oil stain release moisture transporting fiber form comprising a synthetic resin selected from the group consisting of polyolefins and polyacrylonitriles, said fiber form being surface fluorinated from about [$4 \times 10^{-7}$ to $4 \times 10^{-1}$ mg F/cm$^2$] $1 \times 10^{-6}$ to $1 \times 10^{-3}$ mg F/cm$^2$ on an after wash basis, said fluorinated fiber form exhibiting a neutralization equivalent of below about [$1 \times 10^6$] $2 \times 10^5$ and an F/COOH ratio no greater than 25.

2. The fluorinated fiber form of claim 1 wherein the resin is a polyolefin selected from the group consisting of polyethylene and polypropylene.

3. The fluorinated fiber form of claim 1 wherein the resin is a polyacrylonitrile.

4. The fluorinated fiber form of claim 1 wherein the fiber form is fabric.

5. A method for surface treating an unfluorinated fiber form comprising a synthetic resin selected from the group consisting of polyacrylonitriles and polyolefins which consists essentially of contacting the fiber form for less than 15 minutes with a fluorine containing gas having from about 0.2–1% by volume of elemental oxygen, and from about 0.5–5% by volume of elemental fluorine to a combined fluorine level in said fiber form of from $1 \times 10^{-6}$ to $1 \times 10^{-3}$ mg F/cm$^2$ on an after wash basis.

6. The method of claim 5 wherein the fluorine containing gas has less than a 1:5 $O_2/F_2$ ratio.

7. The method of claim 5 wherein the fluorine containing gas has less than about 5% by volume of fluorine.

8. The method of claim 6 wherein the treatment time is less than 5 minutes.

9. The method of claim 6 wherein the fiber form treated is a fabric.

10. The method of claim 6 wherein the fiber form fluorinated is an already dyed fabric.

11. The method of claim 5 wherein the fluorination gas/fiber form contact time is less than about 10 minutes.

12. The method of claim 5 wherein the fluorination gas/fiber form contact time is less than about 1 minute.

* * * * *

UNITED STATES PATENT AND TRADEMARK OFFICE

CERTIFICATE OF CORRECTION

PATENT NO. : 4,020,223

DATED : April 26, 1977

INVENTOR(S) : Dale D. Dixon and Larry J. Hayes

It is certified that error appears in the above-identified patent and that said Letters Patent are hereby corrected as shown below:

Column 1, Line 40
Delete "mold" and substitute therefor -- mild --

Column 2, Line 5
Delete "correspndingly" and substitute therefor
-- correspondingly --

Column 4, Line 59
Delete "strain" and substitute therefor -- stain --

Column 10, Line 5
Delete "durig" and substitute therefor -- during --

Column 14, Line 41
Delete "(15% $F_2$84% $N_2$/1% $O_2$)" and substitute therefor
-- (15% $F_2$/85% $N_2$/1% $O_2$) --

Column 15, Claim 1
Omit brackets and all information within brackets.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*